United States Patent [19]

Drone

[11] 4,019,401

[45] Apr. 26, 1977

[54] DUAL PIVOT AXIS CONTROL LEVER

[75] Inventor: Gary Alan Drone, Springfield, Ill.

[73] Assignee: Fiat-Allis Construction Machinery, Inc., Deerfield, Ill.

[22] Filed: Oct. 9, 1975

[21] Appl. No.: 620,965

[52] U.S. Cl. ..... 74/471 XY; 74/491

[51] Int. Cl.[2] ..... G05G 9/02

[58] Field of Search ..... 74/471 XY, 491; 137/636.2; 200/6 A

[56] References Cited

UNITED STATES PATENTS

| | | | |
|---|---|---|---|
| 2,700,904 | 2/1955 | Woods | 74/471 XY |
| 3,188,879 | 6/1965 | Conley | 74/471 XY |
| 3,496,796 | 2/1970 | Alpers et al. | 74/471 XY |
| 3,625,082 | 12/1971 | Muller et al. | 74/471 XY |
| 3,831,633 | 8/1974 | Comer | 74/471 XY X |
| 3,899,934 | 8/1975 | Froumajou | 74/471 XY |
| 3,943,791 | 3/1976 | Casey | 74/471 XY |

*Primary Examiner*—Allan D. Herrmann
*Attorney, Agent, or Firm*—August E. Roehrig, Jr.; Robert A. Brown

[57] ABSTRACT

A uni-lever system for controlling operation of multiple functions. A uni-lever is coupled to linkage for actuating the multiple functions and supported for pivotal movement through a spherical bearing permitting controlled movement in predetermined planes effecting corresponding movement of the actuating linkage. Auxiliary equipment being controlled is coupled through the linkage connected to the uni-lever to respond only to movement of the uni-lever in a particular plane. Movement in the remaining planes is restricted due to the spherical joint and stabilizing linkage.

10 Claims, 3 Drawing Figures

DUAL PIVOT AXIS CONTROL LEVER

BACKGROUND OF THE INVENTION

This invention relates in general to multi-function control mechanisms and, in particular, to a single lever multi-function control system.

More specifically, this invention relates to a uni-lever control system for selectively actuating accessory equipment associated with a vehicle.

In the operation of auxiliary equipment associated with a vehicle, for example, earth moving equipment such as a crawler tractor having dozer blades, loader buckets or ripper teeth, a number of operations are required to maintain control of the vehicle as well as to effect the many different positioning adjustments required to effectively use the auxiliary equipment. To perform these multiple controls for the earth moving vehicle, as well as the auxiliary equipment, in many applications control levers are provided for effecting each separate function of the vehicle and the auxiliary equipment. The provision of separate control levers for each functional movement results in a large number of control levers producing mounting problems due to space requirements, creating a substantial source of noise in the vehicle cab, and becoming a potential source of confusion and hazards to the machine operator.

In order to minimize the number of levers required to control the vehicle and the auxiliary equipment, multi-function control mechanisms have been utilized. These multi-functional control mechanisms minimize the number of individual control levers required through the use of a single lever to selectively actuate the controlled function. In this manner the single multi-function control lever can actuate related functions of the vehicle and/or auxiliary equipment.

The uni-lever systems for controlling multiple functions which have been previously utilized, require compound linkages and/or pivotal connections involving complex linkage to accomplish the multi-function control. Such systems require a resilient boot to seal out the objectional noises transmitted through the control mechanism and present an unacceptable appearance. These resilient boots quickly deteriorate losing their noise damping capabilities and become objectional in appearance. The present invention in an improved uni-lever multiple-function control mechanism which eliminates the necessity of complex or compound linkage as well as a noise damping resilient boot.

SUMMARY OF THE INVENTION

It is, therefore, an object of this invention to improve uni-lever control of multiple functions.

Another object of this invention is to improve damping of noise transmitted through the control system.

A further object of this invention is to eliminate the resilient boot, heretofore required to baffle objectional noises transmitted through the control system by the mechanisms being controlled.

Still another object of this invention is to control the operation of multiple machine functions through a uni-lever control without use of complex and/or compound linkages.

These and other objects are obtained in accordance with the present invention wherein there is provided a uni-lever system for controlling operation of multiple functions. The uni-lever is coupled to linkage for actuating the multiple functions and supported for pivotal movement through a spherical bearing permitting controlled movement in predetermined planes effecting corresponding movement of the actuating linkage. Auxiliary equipment being controlled is coupled through the linkage connected to the uni-lever to respond only to movement of the uni-lever in a particular plane. Movement in the remaining planes is restricted due to the spherical joint and stabilizing linkage.

DESCRIPTION OF THE DRAWINGS

Further objects of the invention, together with additional features contributing thereto and advantages accruing therefrom, will be apparent from the following description of one embodiment of the invention when read in conjunction with the accompanying drawings, wherein.

DESCRIPTION OF A PREFERRED EMBODIMENT

Figure 1:
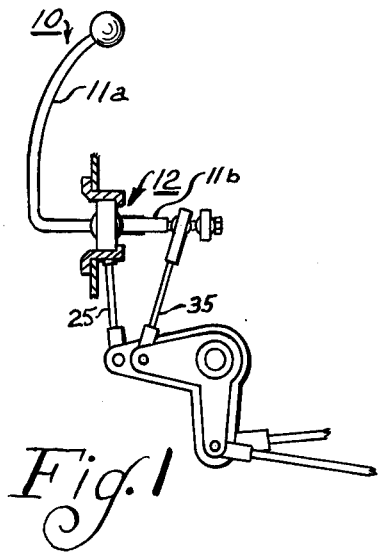
FIG. 1 is a side profile view of the uni-lever control system connected to linkage for selectively actuating the controlled operation.

Referring now to FIG. 1, there is shown one embodiment of a uni-lever control system 10 for selectively actuating multiple independent apparatus or controlled functions. While the uni-lever control is not intended to be limited to any specific application, for convenience of illustration it will be described with reference to its use with earth moving equipment such as a crawler tractor for effecting operation of blade controls. The uni-lever control system includes a lever 11 which is operated by the machine operator for controlling actuation of such functions of the blade as dozer and tilt. The lever 11 is supported in a suitable console within the vehicle cab and positioned adjacent to the operator for convenient accessibility during operation of the tractor.

Figure 2:
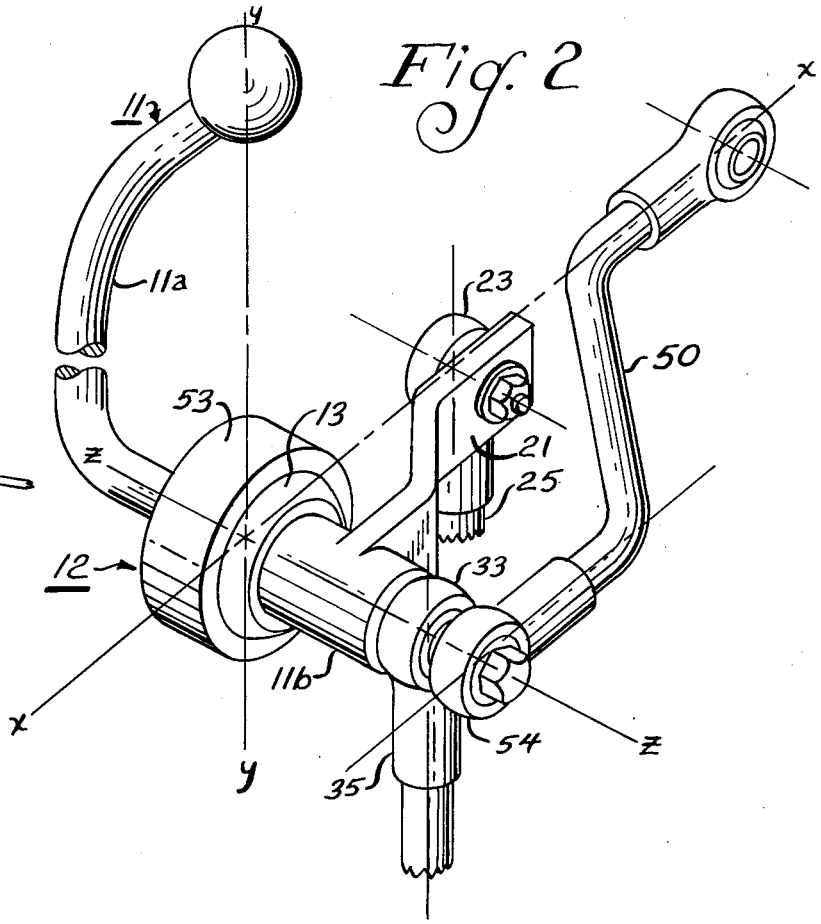
FIG. 2 is a perspective mechanical schematic of the control system to better illustrate the relationship of the planar movement of the uni-lever in controlling the actuation of the associated linkage.

The lever 11 is operatively connected to control rods 25 and 35 the operation of which actuate suitable apparatus, such as hydraulic cylinders (not shown), to effect movement of the controlled function of the dozer or tilt. The lever 11 has a control portion 11*a* which is moved in a predetermined manner and a support portion 11*b* which is operatively connected to the control rods 25 and 35 for operation thereof in response to such movement. A spherical pivot 12 comprising a spherical bearing 13 supported in a console 59 permits the lever 11 to be moved by the operator in predetermined planes as best shown in FIG. 2. The uni-lever 11 extends through the spherical bearing 13 and is supported at one end by a stabilizer link 50 joined to the support portion 11*b* by means of a pivot eye 54. The opposite end of the stabilizer link 50 is connected to a support lug 55 carried by the inner wall of the console 59 by means of a pivot eye 51. The pivot eyes 51 and 54 allow relative movement between the stabilizer link 50 and the lever 11 while supporting the lever and stabilizing its movement.

The control rods 25 and 35 which actuate the mechanism to effect movement of the blade are connected to the support portion 11*b* of the uni-lever 11. The control rod 35 is supported from the support portion 11*b* adjacent to the pivot eye 54 by means of a pivot eye 33 such that rotational movement of the control portion 11*a* of the uni-lever in the *x-y* plane will not effect movement of the linkage rod 35.

Between the pivot eye 33 and the spherical bearing 13 is a linkage bar 21 secured to the support portion 11*b* of the uni-lever 11 by any suitable means such as welding. In this manner movement of the control portion 11*a* of the uni-lever in the *x-y* plane will effect the same movement of the linkage bar 21 through a pivot eye 23 so that rotational movement of the linkage bar will actuate control rod 25.

In operation, control rod 25 is actuated by the machine operator moving the control portion 11*a* of the uni-lever in the *x-y* plane thereby rotating the support portion 11*b* and the linkage bar 21 to actuate control rod 25. Due to the spherical bearing 13, movement of the control portion 11*a* in the *x-y* plane is unlimited so that rotation of the linkage bar will actuate the control rod 25. During this movement of the control portion of uni-lever 11, the support portion 11*b* will freely rotate relative to both the control rod 35 and the stabilizer link 50 due to the pivot eye couplings 33 and 54, respectively.

Actuation of control rod 35 is effected by the machine operator's movement of the control portion 11*a* of the uni-lever in the *y-z* plane. Such movement will pivot the support portion 11*b* upwardly or downwardly effecting similar movement of the control rod 35. The construction of spherical bearing 13 is such that this pivotal movement will not actuate control rod 25. The connection of the stabilizing link 50 to the end of the support portion 11*b* and the support lug 55 by means of the pivot eyes 54 and 51, respectively, permits arcuate movement of the link 50 during actuation of control rod 35 thereby maintaining its stabilizing support without constraining actuation of the control rods.

Figure 3:
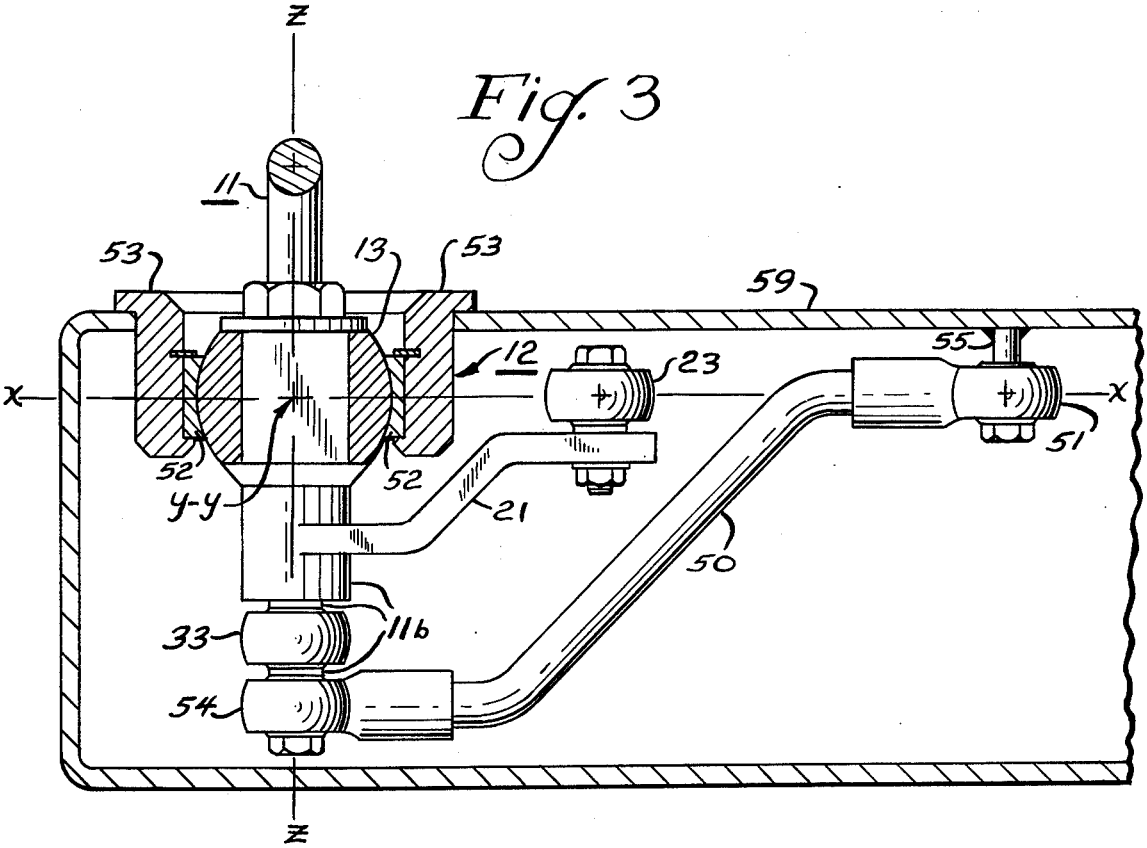
FIG. 3 is a horizontal planar view of the uni-lever control system mounted in a suitable console.

As best shown in FIG. 3, the uni-lever control system 10 is carried in the console 59 by a spherical bearing support 53 which includes suitable bearing blocks or surfaces 52 which conform to the spherical configuration of the spherical bearing 13 and the lug 55. By means of this complete enclosure the machine operator is insulated from any objectional noises which are normally transmitted through the control linkage during operation. In this manner any noise transmission through the control linkage is eliminated by the bearing support secured in the console and the necessity of a resilient boot which has been required in those applications wherein compound or complex linkage movements are used is eliminated.

While the invention has been described with reference to a preferred embodiment it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. Therefore it is intended that the invention not be limited to the particular embodiment disclosed as the best mode contemplated for carrying out this invention but that the invention will include all embodiments falling within the scope of the appended claims.

What is claimed is:

1. A uni-lever control mechanism for selectively operating multiple actuators comprising a lever having a control portion for effecting movement thereof, said control portion selectively movable in predetermined planes, and a support portion operatively connected to said multiple actuators for controlling the actuation thereof in response to movement of said control portion in said predetermined planes, universal pivot means supported by said lever between said control portion and said support portion for effecting multi-planar movement of said control portion, stabilizing means connected to said support portion for stabilizing the movement thereof during multi-planar movement of said control portion, first actuator means operatively connected to said support portion for selectively effecting linear actuating movement to a first controlled function in response to movement of said control portion in a first predetermined plane, second actuator means operatively connected to said support portion for selectively effecting linear actuating movement to a second controlled function in response to move of said control portion in a predetermined plane other than said first predetermined plane, and said stabilizing means comprising a link pivotally connected to said support portion for pivotal movement of said support portion relative thereto when said control portion is moved in said first predetermined plane to actuate the first controlled function, and pivotally secured at a position spaced from said pivotal connection to said support portion to stabilize arcuate movement of said support portion during movement of said control portion in a plane other than said first predetermined plane to actuate the second controlled function.

2. The apparatus of claim 1 wherein said universal pivot means comprises a spherical bearing carried by said lever and operatively connected to said stabilizer means for limiting the movement of said control portion in specific ones of said predetermined planes.

3. The apparatus of claim 1 wherein said support portion further includes a coupling linkage extending substantially perpendicular from the center axis thereof connected to said first actuator means.

4. The apparatus of claim 1 wherein said support portion includes a freely pivotal element connected to said second actuator portion such that said support means is freely rotatable relative to said pivotal element and said second actuator means.

5. The apparatus of claim 1 wherein said stabilizing means connected to said support portion for stabilizing the movement of said control portion is pivotally connected to an end of said support portion removed from said universal pivot means.

6. The apparatus of claim 1 wherein movement of said control portion in said first predetermined plane effects rotational movement of said support portion about said universal pivot means to actuate said first actuator means.

7. The apparatus of claim 1 wherein movement of said control portion in a plane other than said first predetermined plane effects arcuate motion of said support portion about said universal pivot means to actuate said second actuator means.

8. The apparatus of claim 1 wherein said first actuator means comprises a linkage rod connected to said support portion through a coupling link extending outwardly from the center axis thereof, and said second actuator means comprises a linkage rod connected to said support portion by means of a freely pivotal eye connection.

9. A uni-lever control mechanism for selectively operating multiple actuators comprising an L-shaped lever having an upwardly extending control portion for effecting selective movement in predetermined planes and a transversely extending support portion operatively connected to said multiple actuators for controlling the actuation thereof in response to movement of said control portion in said predetermined planes, universal pivot means carried by said lever between said control portion and said support portion for effecting multi-planar movement of said control portion, first actuator means operatively connected to said support portion for selectively effecting linear actuating movement to a first controlled function in response to movement of said control portion in a first predetermined plane, second actuator means operatively connected to said support portion for selectively effecting linear actuating movement to a second controlled function in response to movement of said control portion in a predetermined plane other than said first predetermined plane, stabilizing means pivotally connected to said support portion at an end portion thereof removed from said control portion with said first and second actuator means operatively connected therebetween to stabilize the movement of said support portion during multi-planar movement of said control portion, said support portion connected to said stabilizing means for freely pivotable movement relative thereto for effecting actuation of the first controlled function when said control portion is moved in said first predetermined plane, and said stabilizing means pivotally secured at a position removed from said freely pivotal connection with said support portion for arcuate movement with said support portion to stabilize movement of said support portion when said control portion is moved in a plane other than said first predetermined plane to effect actuation of the second controlled function.

10. The apparatus of claim 9 wherein said stabilizing means comprises a rigid link pivotally connected at one end to said support portion such that said support portion is rotatable relative thereto and pivotally secured at an opposite end laterally offset relative to the center axis of said support portion from the end pivotally connected thereto for arcuate movement with said support portion.

* * * * *